US006017864A

United States Patent [19]

Brittain et al.

[11] Patent Number: 6,017,864

[45] Date of Patent: Jan. 25, 2000

[54] ALKALINE SOLID BLOCK COMPOSITION

[75] Inventors: Kent R. Brittain, Ellsworth, Wis.; Bernard J. Heile, Apple Valley, Minn.; Helmut K. Maier, Golden Valley, Minn.; Charles A. Hodge, Cottage Grove, Minn.; G. Jason Wei, Mendota Heights, Minn.

[73] Assignee: Ecolab Inc., St. Paul, Minn.

[21] Appl. No.: 09/000,693

[22] Filed: Dec. 30, 1997

[51] Int. Cl.[7] ..... C11D 3/22; C11D 3/08; C11D 13/16

[52] U.S. Cl. ..... 510/218; 510/219; 510/224; 510/225; 510/234; 510/439; 510/440; 510/445; 510/446; 510/447; 510/470

[58] Field of Search ..... 510/224, 225, 510/218, 219, 234, 439, 440, 445, 446, 447, 470

[56] References Cited

U.S. PATENT DOCUMENTS

| | | | |
|---|---|---|---|
| 3,337,468 | 8/1967 | Metcalf et al. | 510/534 |
| 4,320,026 | 3/1982 | Cristobal et al | 252/139 |
| 4,861,518 | 8/1989 | Morganson et al. | 252/548 |
| 5,019,290 | 5/1991 | Bruegge et al. | 252/135 |
| 5,674,831 | 10/1997 | Schulz et al. | 510/501 |
| 5,786,320 | 7/1998 | Urfer et al. | 510/470 |

FOREIGN PATENT DOCUMENTS

| | | |
|---|---|---|
| 0 203 523 | 12/1986 | European Pat. Off. . |
| 0 248 936 | 12/1987 | European Pat. Off. . |
| 0 286 342 | 10/1988 | European Pat. Off. . |
| 0 425 369 A1 | 5/1991 | European Pat. Off. . |
| 4342800 | 11/1992 | Japan . |
| 2 199 338 | 7/1988 | United Kingdom . |
| WO 94/24253 | 10/1994 | WIPO . |
| WO 95/18213 | 7/1995 | WIPO . |

OTHER PUBLICATIONS

Preliminary Technical Data Sheet for GLUCOPON® LF–1, Henkel Corporation, Emergy Group, CD Division.

Raw Material Specification for Plurafac LF–500; Plurafac LF–221; Bio Surf Premix; Alkyl Phosphate Ester, Polyacrylic Acid Sod. Salt; and Formula 80.

*Primary Examiner*—Yogendra Gupta
*Assistant Examiner*—Dawn L. Garrett
*Attorney, Agent, or Firm*—Merchant & Gould P.C.

[57] ABSTRACT

We have found that long standing problems relating to the stability of organic materials in alkaline detergents, including the reversion or hydrolysis of condensed phosphate sequestrants in alkaline solid detergent compositions can be alleviated by the use of an organic composition having vicinal hydroxyls. Such a solid block detergent can be manufactured by a process in which a source of alkalinity, a functional material including a condensed phosphate sequestering agent, an organic compound having two vicinal hydroxyl groups, are combined in a pourable composition or liquid. Such a liquid can be introduced into a plastic capsule and solidified. During manufacture and solidification, we have found that the vicinal hydroxyl compound prevents substantial hydrolysis or reversion of the condensed phosphate maintaining effective hardness ion sequestration during the use of the detergent. The stabilizer can also stabilizes color, chlorine content and dispensing properties.

57 Claims, 9 Drawing Sheets

ALKALINE SOLID BLOCK COMPOSITION

FIELD OF THE INVENTION

The invention relates to inorganic alkaline functional materials that can be manufactured in the form of a solid block. Functional materials include detergents, presoaks, enzyme based cleaners, sanitizers, etc. In the manufacture of the solid functional material or detergent, a flowable or liquid mixture is formed into a block or is placed in a large container, bottle or capsule for solidification. After solidification, the solid water soluble or dispersible material or detergent is typically dispensed by a spray-on dispenser creating an aqueous concentrate used in a target locus. The concentrate can be directed to a variety of loci including a warewashing machine, a laundry machine, a hard surface cleaning apparatus, etc. The disclosed functional material maintains a high degree of functional capability because of the stabilizing nature, particularly at elevated temperatures during manufacture, storage or use, of a vicinal hydroxyl compound.

BACKGROUND OF THE INVENTION

The use of solid block compositions in institutional and industrial cleaning operations was pioneered in Ecolab's SOLID POWER® solids or solid detergent block technology. This technology was first claimed in Fernholz et al., U.S. Reissue Pat. Nos. 32,763 and 32,818. Further, pelletized alkaline detergent materials are shown in Gladfelter et al., U.S. Pat. Nos. 5,078,301; 5,198,198 and 5,234,615. Extruded alkaline detergent materials are disclosed in Gladfelter et al., U.S. Pat. No. 5,316,688.

In these pioneering technologies, substantial attention was focused on how the alkaline materials, based on a substantial proportion of sodium hydroxide can be cast and solidified. The first solid block products used substantial proportions of a solidifying agent, typically sodium hydroxide hydrate, to solidify the cast material in a freezing process using the low melting point of sodium hydroxide monohydrate. In the manufacture of the solid block, the particulate components of the detergent were dispersed in a liquid phase comprising aqueous sodium hydroxide and cooled for the purpose of solidifying a useful, functional solid with the dispersed compositions. The resulting solid comprises a matrix of the hydrated sodium hydroxide with the other detergent ingredients dissolved, dispersed or suspended in the hydrated matrix. In these pioneer products low melting sodium hydroxide hydrate is an ideal detergent candidate because the highly alkaline nature of the caustic material produces excellent cleaning and efficient manufacture. Another hydration type process for making cast, caustic or carbonate based detergent are disclosed in Heile et al., U.S. Pat. Nos. 4,595,520 and 4,680,134.

During the manufacture of solid block detergent compositions, we have found that condensed phosphate compositions can be hydrolytically unstable or can revert to less active phosphate species. When contacted with strong base, water and castable liquid compositions, the condensed phosphate compositions can hydrolyze and form orthophosphate or pyrophosphate compositions. The strong base and other chemical constituents of the solid block detergents can also have deleterious effects on chlorine sources, organic materials and the uniformity of dispensing. Chlorine sources are often used for destaining. Such active chlorine sources often react with compositions in the solid block and are substantially reduced in activity or concentration under harsh conditions. Organic materials such as the nonionic surfactants or defoamer compositions can react and brown, discoloring the solid. A variety of enzyme compositions can also be unstable in contact with the alkaline materials in the solid functional material. The instability can be the result of chemical incompatibility or high temperature deactivation of the enzyme protein structure. Lastly, under certain circumstances, the cast solid block material can dispense nonuniformly. By nonuniform dispensing we mean that as the aqueous spray in a spray on dispenser contacts the surface of the alkaline material within a capsule, a hemispherical eroded surface is formed. That is, the caustic material is consumed, the hemispherical surface erodes through the caustic mass until the spray reaches the bottle bottom leaving "shoulders" of the caustic material in the bottom corners of the capsule. As spray on dispensing continues, these shoulders can often crumble and result in dispenser plugging and nonuniform dispensing.

In the commercial manufacture of solid caustic materials, the hydrolysis of condensed phosphate additives can be controlled using a variety of careful process controls. Encapsulated chlorine sources have been used in solid detergents to avoid chlorine instability problems. A significant need exists to improve encapsulated chlorine source stability in solid block detergents. Further, the stability of one or more organic materials in the harsh caustic solid block environment when coming in contact with reactive chlorine sources, etc., can result in substantial instability. A need exists to increase the stability of organic materials in solid block detergents. Lastly, the improved uniformity in dispensing can improve economy in the use of solid block detergents. Accordingly, a need exists to enhance dispensing uniformity. A substantial need exists to improve the quality of the dispensing or erosion caused by the action of the water spray on the surface of the solid detergent. Further, when the capsule is nearly depleted of detergent, the nonuniform dissolution of the material can introduce an excess or minimal amount of cast solid material into the liquid concentrate which is then directed into the warewashing machine.

An extrusion technology has been developed in which condensed phosphate hydrolysis has been minimized during production by reducing the amount of water and the heat history of the composition during manufacture. Such conditions prevent hydrolysis because the materials are not substantially heated and even if heated, do not come in contact with sufficient water to produce a hydrolytic reaction condition. Such processes are shown in Olson et al., U.S. Ser. No. 08/176,541, Schultz et al., U.S. Ser. No. 08/175,626 and Schultz et al., U.S. Ser. No. 08/175,950, now abandoned.

In the manufacture of solid detergents the use of organic solidification agents is also known. Such agents include a large variety of materials including materials that solidify by cooling and hardening at a temperature below their melting point. One example of such a hardening agent is polyalkylene oxides including polyethylene oxide, polypropylene oxide and block or heteric (including random, statistical, alternating, and graft) copolymers thereof. Typically, such materials have a molecular weight greater than about 800 to 8000 and higher, do not contain vicinal hydroxyls and have not been shown in the past to contribute to hydrolytic stability of condensed phosphate materials. Representative examples of such a disclosure is shown in Morganson, U.S. Pat. No. 4,624,713 and 4,861,518.

Cristobal, U.S. Pat. No. 4,320,026 teaches using a diol compound to reduce discoloration in solid detergents.

Alternate methods of reducing hydrolytic instability of condensed phosphates have utility in areas where access to known technology is limited. Such can include small manufacturers, remote manufacturers or sites with limited processing capability. Accordingly, a substantial need exists to provide alternative solid detergent manufacturing capability with reduced condensed phosphate hydrolytic stability. Further, such alternative methods should also aid in improving stability of encapsulated chlorine sources, organic compound stability, enzyme stability and dispensing uniformity.

BRIEF DISCUSSION OF THE INVENTION

We have found that combining a $C_4$ or higher preferably a $C_{4-16}$ organic compound having at least two vicinal hydroxyl groups in a liquid composition that is cast to form a solid block detergent composition, can (1) suppress or reduce hydrolysis or reversion of condensed phosphate sequestrants into less active forms, (2) reduce loss of available chlorine ($Cl_2$) yielding compounds, (3) reduce color change of organic materials in solid detergents (4) can increase enzyme stability and (5) improve the quality of erosion of the solid during dispensing.

The solid block functional composition made according to the invention exhibits a reversion rate of 15 wt-% or less of the condensed phosphate sequestering agent originally present. Preferably, less than 10 wt-% of the condensed phosphate sequestering agent is reverted, more preferably less than about 7 wt-% undergoes reversion. Typically, the organic compound is added to the flowable liquid or semi-liquid dispersion composition prior to the addition of the condensed phosphate sequestrant. Sufficient organic compound is added to limit reversion, or otherwise stabilize or improve the properties of the solid block, such that, after the material is cast and solidified, the composition contains typically a source of alkalinity, greater than 80 wt./wt. %, preferably greater than 90 wt./wt. % of the amount of condensed phosphate sequestrant added during preparation. The organic compound reversion inhibitor optionally, in combination with a variety of other useful compositions, provide positive cleaning benefits. Such amounts of stabilizing compound reduces chlorine losses during mixing and processing of the solid detergent. In addition, the stabilizing compound inhibits a browning color change in organic ingredients in the solid detergent. The solid block detergent, dispensed from a spray-on dispenser, erodes uniformly and does not plug during the dispensing of an aqueous detergent concentrate to the warewashing machine. Lastly, enzyme components retain surprising amounts of activity in the block chemicals.

Accordingly, the invention is found in a method of manufacturing a solid block functional composition. This method describes stabilization of the components of the composition, including inhibition or reduction of the hydrolytic instability of condensed phosphate sequestering agents. This is achieved by combining an effective amount of an inorganic source of alkalinity, at least about 10 wt-% of a condensed phosphate sequestering agent, an effective amount of a reversion inhibitor comprising a $C_4$ to $C_6$ organic compound having at least two vicinal hydroxyl groups. The composition is blended and formed into a solid in which less than about 15 wt-% of the phosphate is reverted.

The invention is also found in a solid block alkaline detergent composition which is made according to this method. The detergent composition includes about 10 to 80 wt-% of an inorganic source of alkalinity, about 10 to 45 wt-% of a condensed phosphate sequestering agent and about 1 to 15 wt-% of a reversion inhibitor. In the resulting composition, less than about 15 wt-% of the phosphate is reverted.

In another embodiment, the invention is found in a solid stabilized block alkaline functional material in which the functional material is either an enzyme, a nonionic surfactant or a chlorine source. The composition includes about 10 to 60 wt-% of an inorganic source of alkalinity, about 0.1 to 60 wt-% of the above-referenced functional material and about 1 to 15 wt-% of an organic stabilizer compound.

For the purpose of this patent disclosure, the term "at least two vicinal hydroxyls" refers to a dihydroxy, trihydroxy or polyhydroxy compound having a structure in the compound that includes the fragment:

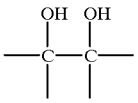

wherein each empty bond can be directed to hydrogen, carbon, oxygen, nitrogen, sulfur, or other atoms common in the molecules of organic materials that can be used in the solid detergent. We have also found that the vicinal compounds of the invention are improved by a borate compound.

For the purpose of this patent application, the term "reversion" or "reverted" or "hydrolytic instability" relates to the tendency of condensed phosphate sequestrant such as sodium tripolyphosphate (STPP) to react with water at elevated temperature to form a blend of pyrophosphate and orthophosphate or to form substantially orthophosphate. Since condensed phosphates such as tripolyphosphate are typically manufactured by heating phosphate species until they condense, lose water and form condensed phosphate, the relatively high energy bonds between the phosphate moieties tend to be hydrolytically unstable particularly in the presence of heat and/or caustic.

BRIEF DISCUSSION OF THE DRAWINGS

FIGS. 1 through 8 demonstrate the unique value of the invention in which the vicinal hydroxyl compounds protect inorganic condensed phosphate hardness sequestering agents from hydrolytic instability or reversion under a variety of conditions and formulations. FIG. 9 is a bar graph showing surprisingly improved soil (particularly lipstick soil) removing properties.

DETAILED DISCUSSION

The stabilized block functional materials of the invention contain a vicinal hydroxide compound reversion inhibitor or chemical stabilizer. We have found a class of organic hydroxy compounds that appears to interact with sources of alkali, inorganic condensed phosphates water and other components such as organics, chlorine source, enzyme, etc., in such a way to reduce condensed phosphate hydrolysis during manufacture and storage and increase stability and dispersibility.

We have found functional materials including alkaline detergent, enzyme based cleaners, sanitizer, rinse agent, etc. In the manufacture of such materials, the active functional material such as an enzyme, surfactant, sanitizer, etc. is formed in a solid matrix of an alkaline material. As the alkaline material is dispensed, the included functional material is dissolved or suspended in the aqueous concentrate for use in a use locus. In the solid functional material, we have found that the vicinal hydroxy compound stabilizes a condensed phosphate, an enzyme, an organic surfactant such as a nonionic surfactant or other material and improves dispensing properties.

The reversion stabilizer compositions of the invention include an organic $C_4$ compound with at least one vicinal hydroxide group corresponding to the following formula:

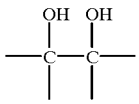

wherein the empty bonds correspond to carbon, oxygen, hydrogen, sulfur, nitrogen or other common atoms in available stabilizer compounds. The simplest examples are glycerin derivatives such as glycerin lower alkyl monoesters and ethers including glyceryl monostearate, glyceryl monooleate, glyceryl-monoethyl ether, glyceryl-diethyl ether, etc. 2,3-dihydroxybutyraldehyde, and other $C_{4+}$ organic compounds having vicinal hydroxyls. One class of preferred reversion inhibitors are the monosaccharides including aldotetrose, aldopentose, aldohexose, aldoheptose, aldooctose, ketotetrose, ketopentose, ketohexose, etc. compounds. Such compounds include erythrose, ribose, glucose, mannose, galactose, isomers and derivatives thereof and other similar monosaccharides. Additionally, disaccharides compounds including sucrose, lactose, cellobiose, maltose are useful. Higher trisaccharides, oligosaccharides and large molecular polysaccharides can also be used selectively but appear to have reduced activity. Cellulose and oxidized cellulosic materials, while considered a polysaccharide appears to have reduced utility in this application. Compounds that are structurally similar to such carbohydrates can also be used. These compounds include 1,1-dihydroxycyclohexane, 1,2,3-trihydroxycyclohexane, sorbitol, and derivatives thereof, etc. can often be used.

Preferably, the reversion inhibitor comprises a compound with three or more vicinal hydroxyl groups. In another embodiment, the reversion inhibitor is a carbohydrate, preferably a $C_{4-6}$ carbohydrate or mixtures thereof.

Alkaline Sources

To provide an alkaline pH, the solid functional composition comprises an alkalinity source. Generally, the alkalinity source raises the pH of the composition to at least 10.0 in a 1 wt-% aqueous solutions and preferably the pH is in a range of from about 10.5 to 14. Such pH is sufficient for soil removal and particle breakdown when the chemical is placed in use and further facilitates the rapid dispersion of soils. The general character of the alkalinity source is limited only to those chemical compositions which have a substantial aqueous solubility. Exemplary alkalinity sources include an alkali metal carbonate, silicate, hydroxide or mixtures thereof. The alkalinity source can be augmented by conventional builders which build detergent activity by complexing hardness ions.

The composition produced according to the invention may include effective amounts of one or more alkaline sources to enhance cleaning of a substrate and improve soil removal performance of the composition. The composition comprises about 10–80 wt-%, preferably about 15–70 wt-% of an alkaline source, most preferably about 20–60 wt-%. The total alkalinity source can comprise an alkali metal hydroxide, carbonate or silicate. Metal carbonate such as sodium or potassium carbonate, bicarbonate, sesquicarbonate, mixtures thereof and the like can be used. Suitable alkali metal hydroxides include, for example, sodium or potassium hydroxide. An alkali metal hydroxide may be added to the composition in the form of solid beads, dissolved in an aqueous solution, or a combination thereof. Alkali metal hydroxides are commercially available as a solid in the form of prilled solids or beads having a mix of particle sizes ranging from about 12–100 U.S. mesh, or as an aqueous solution, as for example, as a 50 wt-% and a 73 wt-% solution. Examples of useful alkaline sources include a metal silicate such as sodium or potassium silicate (with a $M_2O:SiO_2$ ratio of 1:2.4 to 5:1, M representing an alkali metal) or metasilicate; a metal borate such as sodium or potassium borate, and the like; organic bases such as ethanolamines and amines; and other like alkaline sources can be used. The alkalinity source can include an alkali metal hydroxide including sodium hydroxide, potassium hydroxide, lithium hydroxide, etc. Mixtures of these hydroxide species can also be used. Alkaline metal silicates can also act as a source of alkalinity for the detergents of the invention. Useful alkaline metal silicates correspond with the general formula ($M_2O:SiO_2$) wherein for each mole of $M_2O$ there is less than one mole of $SiO_2$. Preferably for each mole of $SiO_2$ there is from about 1 to about 100 moles of $M_2O$ wherein M preferably comprises sodium or potassium. In the preferred silicate the $Na_2O:SiO_2$ ratio is about 1:2 to 20:1. Preferred sources of alkalinity are alkaline metal hydroxides, alkali metal orthosilicate, alkaline metal metasilicate, and other well known detergent silicate materials.

Sequestrants

In order to soften or treat water, prevent the formation of precipitates or other salts, the composition of the present invention generally comprises components known as chelating agents, builders or sequestrants. Generally, sequestrants are those molecules capable of complexing or coordinating the metal ions commonly found in service water and thereby preventing the metal ions from interfering with the functioning of detersive components within the composition. Any number of sequestrants may be used in accordance with the invention. Representative sequestrants include salts of amino carboxylic acids, phosphonic acid salts, water soluble acrylic polymers, among others. The molecular weight (Mn) of these polymeric materials is about 200–8000 preferably 4000–6000.

An essential ingredient of a stabilized cast solid detergent materials of the invention is a condensed phosphate sequestrant. The term "condensed phosphate" indicates a material having at least one group according to the formula:

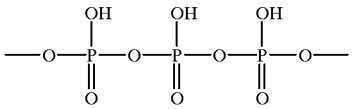

wherein the empty bonds are directed to other phosphate groups, cations, etc. which can be part of a linear, condensed or cyclic phosphate composition.

Compounds with phosphate moieties useful as sequestrants are alkali metal condensed phosphates, cyclic phosphates, organo phosphonic acids and organo phosphonic acid salts. Useful condensed phosphates include alkali metal pyrophosphate, an alkali metal polyphosphate such as sodium tripolyphosphate (STPP) available in a variety of particle sizes. Useful organo phosphonic acids include, mono, di, tri and tetra-phosphonic acids which can also contain groups capable of forming anions under alkaline conditions such as carboxy, hydroxy, thio and the like.

In one embodiment, the condensed phosphate sequestering agent is an alkali metal tripolyphosphate present at a concentration of 15 to 50 wt-% of the composition. Preferably, the tripolyphosphate has a particle size of about 200 to 900 microns. Preferably, said tripolyphosphate forms a barrier coating.

The tendency of the condensed phosphate materials to revert can be controlled by using a condensed phosphate that reduces the impact of caustic and water on the sequestrant material. Such effects can be reduced by using an effective particle size sequestrant and by using barrier technologies.

The inorganic condensed phosphate can also be combined with an organic carboxylate, phosphonate, phosphonic acid or phosphonic acid salt. The organic materials can aid in sequestering hardness ions in cleaning processes. Suitable amino carboxylic acid chelating agents include N-hydroxyethyliminodiacetic acid, nitrilotriacetic acid (NTA), ethylenediaminetetraacetic acid (EDTA), N-hydroxyethylethylenediaminetriacetic acid (HEDTA), and diethylenetriaminepentaacetic acid (DTPA). When used, these amino carboxylic acids are generally present in concentrations ranging from about 1 wt-% to 50 wt-%, preferably from about 2 wt-% to 45 wt-%, and most preferably from about 3 wt-% to 40 wt-%.

Other suitable sequestrants include water soluble acrylic polymers having pendant —$CO_2^{-1}$ groups, used to condition the wash solutions under end use conditions. Such polymers include polyacrylic acid, polymethacrylic acid, acrylic acid-methacrylic acid copolymers, acrylic acid-itaconic acid copolymers, hydrolyzed polyacrylamide, hydrolyzed methacrylamide, hydrolyzed acrylamide-methacrylamide copolymers, hydrolyzed polyacrylonitrile, hydrolyzed polymethacrylonitrile, hydrolyzed acrylonitrile methacrylonitrile copolymers, or mixtures thereof. Water soluble salts or partial salts of these polymers such as their respective alkali metal (for example, sodium or potassium) or ammonium salts can also be used. The number average molecular weight of the polymers is from about 4000 to about 12,000. Preferred polymers include polyacrylic acid, the partial sodium salts of polyacrylic acid or sodium polyacrylate having an average molecular weight within the range of 4000 to 8000. These acrylic polymers are generally useful in concentrations ranging from about 0.5 wt-% to 20 wt-%, preferably from about 1 to 10, and most preferably from about 1 to 5.

Also useful are phosphonic acids are 1-hydroxyethane-1, 1-diphosphonic acid; aminotri(methylenephosphonic acid); aminotri-(methylenephosphonate), sodium salt 2-hydroxy ethyl-iminobis(methylenephosphonic acid); diethylenetriaminepenta(methylenephosphonic acid) ;diethylene-triaminepenta(methylenephosphonate) sodium salt; hexamethylenediamine(tetramethylenephosphonate), potassium salt; bis(hexamethylene) triamine (pentamethylenephosphonic acid) $(HO_2)POCH_2N[(CH_2)_6N[CH_2PO(OH)_2]_2]_2$; and phosphorus acid $H_3PO_3$. The preferred phosphonate is aminotrimethylenephosphonic acid or salts thereof combined optionally with diethylenetriaminepenta(methylenephosphonic acid). When used as a sequestrant in the invention, phosphonic acids or salts are present in a concentration ranging from about 0.25 to 25 wt-%, preferably from about 1 to 20 wt-%, and most preferably from about 1 to 18 wt-% based on the solid detergent.

Solidifying Agent

The invention may also comprise solidifying agent to create a solid detergent mass from a blend of chemical components. Generally, any agent or combination of agents which provides a requisite degree of solidification and aqueous solubility may be used with the invention. A solidification agent may be selected from any organic or inorganic compound which imparts a solid character and/or controls the soluble character of the present composition when placed in an aqueous environment. A preferred agent is one that forms a hydrate of a metal hydroxide or carbonate. The solidifying agent may provide for controlled dispensing by using solidification agents which having increased aqueous solubility. For systems which require less aqueous solubility or a slower rate of dissolution an organic nonionic or amide hardening agent may be appropriate. For a higher degree of aqueous solubility, an inorganic solidification agent or a more soluble organic agent such as urea can be used.

Compositions which may be used with the present invention to vary hardness and solubility include amides such as stearic monoethanolamide, lauric diethanolamide, and stearic diethanolamide. Nonionic surfactants have also been found to impart varying degrees of hardness and solubility when combined with a coupler such as propylene glycol or polyethylene glycol. The color stability of the nonionics are improved by the presence of the stabilizing compounds of the invention. Nonionics useful in this invention include nonylphenol ethoxylates, linear alkyl alcohol ethoxylates, ethylene oxide/propylene oxide block copolymers such as the Pluronic® surfactants commercially available from BASF Wyandotte. Nonionic surfactants particularly desirable as hardeners are those which are solid at room temperature and have an inherently reduced aqueous solubility as a result of the combination with the coupling agent. Other surfactants which may be used as solidifying agents include anionic surfactants which have high melting points to provide a solid at the temperature of application. Anionic surfactants which have been found most useful include linear alkyl benzene sulfonate surfactants, alcohol sulfates, alcohol ether sulfates, and alpha olefin sulfonates. Generally, linear alkyl benzene sulfonates are preferred for reasons of cost and efficiency. Other compositions that can be used as hardening agents in the solid compositions of the invention include urea, also known as carbamide, and other organic solidifying agents including PEGs, nonionic surfactants, etc. The solidifying agents can be used in concentrations which promote solubility and the requisite structural integrity for the given application. Generally, the concentration of solidifying agent ranges from about 0 wt-% to 50 wt-%, 5 wt-% to 45 wt-%, preferably from about 10 wt-% to 25 wt-%, and most preferably from about 15 wt-% to 20 wt-%.

Enzyme

The composition of the invention may also comprise about 0.01 to 10 wt-% of an enzyme, preferably about 0.5 to 5 wt-% for reasons of soil removal and most preferably about 1.0 wt-% of an enzyme for reasons of soil removal. Suitable enzymes include but are not limited to the following: protease, esperase, amylase, lipase, and combinations thereof. Esperase and protease serve to break down protein, whereas amylase breaks down starch and lipase breaks down fats. If three enzymes are utilized, the broad range for each enzyme would range from between about 0.1 to 5.0 wt-%. Thus, the presoak can comprise up to 15 wt-% enzyme if three different enzymes are utilized.

We have found that the solid enzyme containing detergents stabilized by the stabilizing compounds of the invention can be further enhanced using a borate stabilizing material. The combination of an alkali metal borate with the vicinal hydrocarbon stabilizer compositions of the invention produce enhanced stability. Boric acid chemistry, like many other chemistries is complex and contains many simple and complex compounds. The principal anion in an alkali metal borate species is an alkali metal (1:1) borate such as $Na_2O.B_2O_3.4H_2O$. Mixtures of $B(OH)_3$ and $B(OH)_4^{-1}$ also appear in classic buffer systems depending on pH. Sodium borate, potassium borate, disodium tetraborate, disodium tetraborate pentahydrate, disodium tetraborate tetrahydrate, etc. can be used in the stabilized materials of the invention.

Bleaching Source

The detergent composition of the invention may also comprise an encapsulated chlorine or bleaching source preferably chloroisocyanurates, sodium salt which liberates $OCl^-$ under conditions normally encountered in typical cleaning processes. Preferred species include sodium dichloroisocyanaurate, potassium dichloroisocyanurate, pentaisocyanurate and hydrates thereof. A preferred source of chlorine comprises an encapsulated chlorine source. Such encapsulated chlorine sources are shown in Olson et al., U.S. Pat. Nos. 4,681,914 and 5,358,635. Preferably, such an encapsulated chlorine source can be used in a solid block functional composition. Preferably, less than 30 wt-% of the encapsulated chlorine activity is lost during manufacture and packaging. The chlorine releasing substances suitable as the core material of the encapsulated active chlorine compound include chlorine components capable of liberating active chlorine species such as HOCl, under conditions normally used in warewashing and laundry processes. The functional material can comprise about 0–10 wt-% of a bleaching source, or encapsulated bleach preferably about 2–6 wt-% for reasons of economy, and most preferably about 5 wt-% for reasons of cost effectiveness. Suitable bleaching sources include but are not limited to the following: calcium hypochlorite, lithium hypochlorite, chlorinated trisodium phosphate, sodium dichloroisocyanurate dihydrate, potassium dichloroisocyanurate dihydrate, sodium dichloroisocyanurate, bleaching source comprises sodium dichloroisocyanurate dihydrate for reasons of availability and economy.

Sanitizer Composition

Sanitizer compositions, the solid functional material in block form of the invention can contain the sanitizing agent. Sanitizing agents can comprise bleaching agents (disclosed above) or a variety of other materials. Useful sanitizing agents include hydrogen peroxide, peroxy carboxylic acids, glutaraldehyde, quaternary ammonium compounds and a variety of other materials. A preferred sanitizing composition comprises a peroxycarboxylic acid sanitizer. Such materials typically made by oxidizing a monocarboxylic acid using hydrogen peroxide. Generally, the useful concentrations of the peroxy carboxylic acid sanitizer typically range from about 0.1 to 40 wt-%, preferably 3 to 30 wt-%.

Nonionic Surfactants and Rinse Aids

Nonionic surfactants useful in the context of this invention are generally polyether (also known as polyalkylene oxide, polyoxyalkylene or polyalkylene glycol) compounds. More particularly, the polyether compounds are generally polyoxypropylene or polyoxyethylene glycol compounds. Typically, the surfactants useful in the context of this invention are synthetic organic polyoxypropylene (PO)-polyoxyethylene (EO) block copolymers. These surfactants comprise a diblock polymer comprising an EO block and a PO block, a center block of polyoxypropylene units (PO), and having blocks of polyoxyethylene grafted onto the polyoxypropylene unit or a center block of EO with attached PO blocks. Further, this surfactant can have further blocks of either polyoxyethylene or polyoxypropylene in the molecule. The average molecular weight of useful surfactants ranges from about 1000 to about 40,000 and the weight percent content of ethylene oxide ranges from about 10–80% by weight.

The composition of the invention may also comprise a defoaming surfactant or rinse aid surfactant useful in warewashing compositions. A defoamer is a chemical compound with a hydrophobe-hydrophile balance suitable for reducing the stability of protein foam. The hydrophobicity can be provided by an oleophilic portion of the molecule. For example, an aromatic alkyl or alkyl group, an oxypropylene unit or oxypropylene chain, or other oxyalkylene functional groups other than oxyethylene provide this hydrophobic character. The hydrophilicity can be provided by oxyethylene units, chains, blocks and/or ester groups. For example, organophosphate esters, salt type groups or salt forming groups all provide hydrophilicity within a defoaming agent. Typically, defoamers are nonionic organic surface active polymers having hydrophobic groups, blocks or chains and hydrophilic ester groups, blocks, units or chains. However, anionic, cationic and amphoteric defoamers are also known. Phosphate esters are also suitable for use as defoaming agents. For example, esters of the formula $RO—(PO_3M)_n—R$ wherein n is a number ranging from 1 to about 60, typically less than 10 for cyclic phosphates, M is an alkali metal and R is an organic group or M, with at least one R being an organic group such as an oxyalkylene chain. Suitable defoaming surfactants include ethylene oxide/propylene oxide blocked nonionic surfactants, fluorocarbons and alkylated phosphate esters. When present defoaming agents may be present in a concentration ranging from about 0.1 wt-% to 10 wt-%, preferably from about 0.5 wt-% to 6 wt-% and most preferably from about 1 wt-% to 4 wt-% of the composition. Rinse aids are selected for sheeting action and surface energy.

Also useful in the context of this invention are surfactants comprising alcohol alkoxylates having EO, PO and BO blocks. Straight chain primary aliphatic alcohol alkoxylates can be particularly useful as sheeting agents. Such alkoxylates are also available from several sources including BASF Wyandotte where they are known as 'Plurafac' surfactants. A particular group of alcohol alkoxylates found to be useful are those having the general formula $R—(EO)_m—(PO)_n$ wherein m is an integer of about 2–10 and n is an integer from about 2—20. R can be any suitable radical such as a straight chain alkyl group having from about 6–20 carbon atoms.

Other useful nonionic surfactants of the invention comprise capped aliphatic alcohol alkoxylates. These end caps include but are not limited to methyl, ethyl, propyl, butyl, benzyl and chlorine. Preferably, such surfactants have a molecular weight of about 400 to 10,000. Capping improves the compatibility between the nonionic and the oxidizers hydrogen peroxide and percarboxylic acid, when formulated into a single composition.

Another useful nonionic surfactant of the invention comprises a fatty acid alkoxylate wherein the surfactant comprises a fatty acid moiety with an ester group comprising a block of EO, a block of PO or a mixed block or heteric group. The molecular weights of such surfactants range from about 400 to about 10,000, a preferred surfactant comprises an EO content of about 30–50 wt-% and wherein the fatty acid moiety contains from about 8 to about 18 carbon atoms.

Similarly, alkyl phenol alkoxylates have also been found useful in the manufacture of the rinse agents of the invention. Such surfactants can be made from an alkyl phenol moiety having an alkyl group with 4 to about 18 carbon atoms, can contain an ethylene oxide block, a propylene oxide block or a mixed ethylene oxide, propylene oxide block or heteric polymer moiety. Preferably, such surfactants have a molecular weight of about 400 to about 10,000 and have from about 5 to about 20 units of ethylene oxide, propylene oxide or mixtures thereof.

The functional composition can contain the following general composition formulation:

Composition Table

| Ingredients generic formulae for ware, laundry and hard surface cleaning | Useful (Wt./Wt-%) | Preferred (Wt./Wt-%) |
|---|---|---|
| Alkali metal hydroxide | 0–70 | 15–60 |
| $C_{4+}$ Inhibitor Compound | 0.1–20 | 1–10 |
| Silicate alkaline source | 0–60 | 1–45 |
| Other Alkaline source (carbonate) | 0–60 | 1–45 |
| Detergent Surfactant (laundry/hard surface applications; nonionic and/or anionic) | 1–40 | 3–20 |
| Rinse aid nonionic | 0–60 | 0.1–30 |
| Sequestrant | 1–45 | 5–40 |
| Defoamer composition | 0.01–5 | 0.1–2 |
| Sanitizer | 0–40 | 3–30 |
| Encapsulated Chlorine Source | 0–15 | 0.1–10 |
| Enzyme | 0–15 | 0.1–10 |
| Organic functional material (Optical Brightener) | 0–10 | 0.1–5 |
| Solidifying agent | 0–45 | 0.1–20 |

Processes used to make the solid block material of the invention typically involve preparing a liquid or pourable material containing the ingredients of the invention which is then placed in a container for cooling and solidification. Preferably, the solid does not substantially discolor after the blended mass is formed into a solid. Preferably, the blended mass is formed into a solid in a plastic container. The liquid portion of the castable material typically contains components of a solidifiable matrix. The solidified form of the solid block detergent comprises a solid matrix having particulate warewashing ingredients dispersed throughout the solid matrix. This process technology that can be used to make the said detergents of the invention is disclosed in Fernholz et al., U.S. Reissue Pat. Nos. 32,763 and 32,818. Further, pelletized alkaline detergent materials processing is shown in Gladfelter et al., U.S. Pat. Nos. 5,078,301; 5,198,198 and 5,234,615. Extruded alkaline detergent materials processing is disclosed in Gladfelter et al., U.S. Pat. No. 5,316,688. Another hydration type process for making cast, caustic or carbonate based detergent is disclosed in Heile et al., U.S. Pat. Nos. 4,595,520 and 4,680,134.

These cast solid detergent materials are conventionally dispensed using water spray-on dispensers that dissolve the solid block material from the plastic bottle or capsule for use in a warewashing machine. The foregoing discussion provides a basis for understanding the invention.

The following mixing procedures and examples and data provide an understanding of the manufacturing end use of the invention.

Mix Procedure 1

Low Temperature Processing

| Item | Percent | Weight (lbs) |
|---|---|---|
| 50% aqueous NaOH | 23.3 | 16.3 |
| Water | 5.8 | 4.1 |
| Phosphate Ester defoamer | 0.3 | 0.2 |
| Nonionic Surfactant | 1.7 | 1.2 |
| Polyacrylic Acid (50% aqueous active) | 2.0 | 1.4 |
| Sucrose (granulated table sugar) | 6.0 | 4.2 |
| NaOH Bead | 20.2 | 14.2 |
| $Na_2CO_3$ | 5.7 | 3.9 |
| Sodium Tripolyphosphate (STPP) | 30.0 | 21.0 |
| Encapsulated Chlorine Source | 5.0 | 3.5 |

Procedure

1. Add liquid aqueous caustic, surfactant phosphonate ester defoamer and water. Heat to 120° F.
2. Add polyacrylate, Add sucrose.
3. Add NaOH. Add sodium carbonate. Bring temperature to 135 to 140° F.
4. Add sodium tripolyphosphate and encapsulated chlorine source. Pack when viscosity exceeds 4000 cps.

Mix Procedure 2

High Temperature Processing

| Item | Percent | Weight (lbs.) |
|---|---|---|
| Liquid Caustic (50% aqueous) | 9.7 | 6.8 |
| Sodium Chloride ($NaClO_2$) | 0.2 | 0.2 |
| Water | 6.3 | 4.4 |
| Phosphate Ester defoamer | 0.2 | 0.1 |
| Nonionic Surfactant | 1.2 | 0.8 |
| Polyacrylic Acid (50% aqueous active) | 2.0 | 1.4 |
| Sucrose | 6.0 | 4.2 |
| Dye | trace color | (e.g.)~1 gm. |
| NaOH | 37.8 | 26.4 |
| $Na_2CO_3$ | 8.1 | 5.7 |
| STPP | 28.5 | 20.0 |

Procedure

1. Add liquid caustic, Add sodium chlorite, Add water, Add surfactant and defoamer.
2. Heat to 160 to 180° F.
3. Add polyacrylic acid. Mix 15 minutes. Add sucrose. Mix until dissolved. Dissolve dye in 20 mls. of water and add.
4. Add caustic bead.
5. Add sodium carbonate.
6. Bring temperature to 155 to 165° F.
7. Add STPP.
8. Mix and Pack.

Mix Procedure 3

Low Temperature Processing With Precoated Sequestrant

| Item | Percent (based on solid detergent) | Weight (lbs) |
|---|---|---|
| Phosphate Ester defoamer | 0.3 | 0.1 |
| Nonionic Surfactant | 1.7 | 0.6 |
| Granular STPP | 30.0 | 10.5 |

Procedure
1. Add tripoly to ribbon blender.
2. Add surf premix and mix 5 minutes.

| Item | Percent | Weight (lbs) |
|---|---|---|
| 50% aqueous NaOH | 23.3 | 8.2 |
| Water | 5.8 | 2.0 |
| Polyacrylic acid (50% aqueous active) | 2.0 | 0.7 |
| Pentaerythritol | 6.0 | 2.1 |
| NaOH | 20.2 | 7.1 |
| $Na_2CO_3$ | 5.6 | 2.0 |
| Precoated STPP | 32.1 | 11.2 |
| Encapsulated Chlorine Source | 5.0 | 1.8 |

Procedure
1. Add liquid caustic and water. Heat to 120° F.
2. Add polyacrylic acid. Add pentaerythritol.
3. Add NaOH, STPP; add $NaCO_3$ Bring temperature to 120 to 130° F.
4. Add encapsulated chlorine source.
5. Mix and package.

Mix Procedure 4

High Temperature Processing With Precoated Sequestrant

| Item | Percent | Weight (lbs) |
|---|---|---|
| STPP | 28.5 | 20.0 |
| Phosphate Ester defoamer | 0.2 | 0.1 |
| Nonionic Surfactant | 1.2 | 0.8 |

Procedure
1. Add tripoly to ribbon mixer.
2. Add surfactant and mix 5 minutes.

Formula:

| Item | Percent | Weight (lbs) |
|---|---|---|
| Liquid Caustic (50% aqueous) | 9.7 | 6.8 |
| Sodium Chloride ($NaClO_2$) | 0.2 | 0.2 |
| Water | 6.3 | 4.4 |
| Polyacrylic Acid (50% aqueous active) | 2.0 | 1.4 |
| Sucrose | 6.0 | 4.2 |
| Dye | trace color | (e.g.)~1 gm. |

-continued

| Item | Percent | Weight (lbs) |
|---|---|---|
| Caustic Bead | 37.8 | 26.4 |
| $Na_2CO_3$ | 8.2 | 5.7 |
| Precoated STPP | 29.8 | 20.9 |

Procedure
1. Add liquid caustic.
2. Add sodium chlorite.
3. Add water.
5. Heat to 160 to 180° F.
6. Add polyacrylic acid. Mix 15 minutes. Add sucrose. Mix until dissolved. Dissolve dye in 20 mls. of water and add.
7. Add caustic bead.
8. Add dense ash.
9. Bring temperature to 155 to 165° F.
10. Add STPP.
11. Mix and Pack.

Using Mix Procedures 1 and 4, a large volume of experimental work was done to demonstrate improved stability the reversion reduction or STPP hydrolysis control using the vicinal hydroxyl compounds of the invention. A large number of compounds were tested for reversion control at varying temperatures, water content and STPP particle sizes, both with coated and uncoated sodium tripolyphosphate. We have found that under all these varying conditions, the reversion inhibitor provided some degree of control over polyphosphate hydrolysis. The following summary table displays the results of the experimental program. In the table, a percent reversion of sodium tripolyphosphate is shown. This number represents the percent of the added tripolyphosphate that is hydrolyzed. In developing this data, experiments were conducted similar to those shown in Mixed Procedures 1–4 using proportions of the reversion inhibitor that range from about 2 to about 8 wt-%. We have found that as the concentration of the reversion inhibitor increased generally its reversion control increased proportionally. However, the summary table demonstrates our experience in controlling reversion with compounds of the invention.

The following table shows the ability to control STPP reversion. We have achieved low reversion of precoated (6.25 wt-% coating, see Mixing Procedure 3) STPP during production even with difficult to control conditions including high water formula (18.5 to 20 wt-% water), using small particles STPP and with extended mixing times. The results presented are based on 6.0 wt-% addition of reversion inhibitor, except where indicated.

RESULTS TABLE 1
SUMMARY OF RESULTS FROM INHIBITORS OF THE INVENTION AND COMPARATIVE MATERIALS

| Experimental Compound Quantities of reversion inhibitors vary. | % Reversion (based on total weight of solid detergent) | % Reversion (based on STPP) |
|---|---|---|
| Glucopon LF-1 ® (a mixed decyl/octyl ether glucose oligomers; lauryl alcohol ethoxylate-propoxylate surfactant and water) | 1.5 | 5.1 |
| Sorbitol | 1.7 | 5.6 |
| Lactose | 2.0 | 6.7 |
| Sucrose | 2.0 | 6.8 |
| Glucose | 2.5 | 8.3 |

-continued

RESULTS TABLE 1
SUMMARY OF RESULTS FROM INHIBITORS OF THE INVENTION AND COMPARATIVE MATERIALS

| Experimental Compound Quantities of reversion inhibitors vary. | % Reversion (based on total weight of solid detergent) | % Reversion (based on STPP) |
|---|---|---|
| COMPARATIVE MATERIALS | | |
| Oxidized starch | 3.7 | 12.5 |
| Pentaerythritol | 4.3 | 14.4 |
| PVA (Polyvinyl Alcohol) | 4.7 | 15.7 |
| Carboxymethyl cellulose | 6.5 | 21.5 |
| Sucrose ester | 6.5 | 21.6 |

*Not same conditions, but similar.

The summary table shows that the best inhibitor compounds are carbohydrate compounds that are monosaccharide or disaccharide compounds. Preferably, the compound permit a reversion control of less than about 10 wt-% (based on STPP wt-%).

We have also found that the stabilizing compounds of the invention reduce loss of chlorine activity from encapsulated chlorine compounds. The solid detergents of the invention have enhanced stability during manufacture when made with the stabilizing compounds. Without the stabilizer compounds of the invention, the solid detergent could lose 50–85% of the added chlorine activity from the encapsulate after packaging (based on 2–4 hour mix time). With the stabilizer, loss of chlorine activity can be limited to 6–12% under the same conditions.

We have also discovered the ability of the stabilizing compounds of the invention to prevent a color change due to color instability of organic materials in the solid detergents of the invention during manufacture and storage of alkaline warewashing and laundry detergents containing surfactant blends. In Example I below, the addition of an effective amount of sucrose (typically 3 to 6 wt-%) prevents a browning color change in the cast solid detergent. The original white to off-white color does not change.

EXAMPLE I

| Ingredient | Percent |
|---|---|
| RU Silicate (53% water, 33% $SiO_2$ and 14% $Na_2O$) | 42.2 |
| Surfactant Blend: (a) $C_{18}$ alkyl$(EO)_{10}(PO)_{1.5}$ 63%; (b) PO modified alcohol ethoxylate-Plurafac ®LF-500 17%; and (c) mono- and di-alkylphosphate ester 10% | 0.8 |
| NaOH 50% | 9.9 |
| Gran. Sugar (Sucrose) | 3.0 |
| NaOH bead | 11.6 |
| Sod. Metasilicate, Anhy. | 8.0 |
| Coated STPP (14% Surfactant Blend on STPP) | 20.5 |
| Defoamer (nonionic) | 0.2 |
| Encapsulated Chlorine Source | 3.8 |
| Total | 100.0 |

When made with an organic surfactant and brightening agent (Example II), the cast product is a bright yellow solid product. Without stabilizer the product becomes yellow/brown. Stability testing has been performed on the solid material for more than four months without change or discoloration of the original coloration.

EXAMPLE II

| Ingredient | Percent |
|---|---|
| $(C_{16-18})$ alcohol 7 mole ethoxylate | 13.5 |
| $(C_{16-18})$ alcohol 11 mole ethoxylate | 13.5 |
| Sucrose | 2.0 |
| poly (acrylic acid-co-itaconic acid) sequestrant | 2.2 |
| Sodium Hydroxide 50% active aqueous | 17.6 |
| Sodium Hydroxide, Bead | 25.4 |
| Sodium salt of polyacrylic acid | 20.0 |
| Carboxymethylcellulose | 1.0 |
| Tinopal CBS-X | 0.1 |
| Soda Ash ($Na_2CO_3$, dense) | 4.50 |
| Laundry Fragrance | 0.2 |
| TOTAL | 100.0% |

We have also found that the stabilizing compounds of the invention stabilize dispensing characteristics of the solid detergent composition. We have prepared cast solid detergents based on sodium hydroxide (similar to those made in mix procedures 1–4) that contain 6 wt-% of sucrose based on the solid which also contain 12–16 wt-% water. We have found that the addition of sucrose stabilizes the physical integrity of the solid block during spray-on dispensing. The surface of the solid block erodes linearly over the surface of the block and prevents crumbling or breaking apart of the cast solid material. The resulting physical integrity of the solid block provides consistent dispensing until the block is entirely consumed by the spray on dispenser. No part of the solid crumbles from the solid mass and blocks the dispenser.

We have also found that the vicinal compounds of the invention stabilize enzymes in an alkaline solid enzyme cleaner material. We have also noted that natural materials containing carbohydrate, disaccharide, trisaccharide, or polysaccarhide materials are equally useful in stabilizing the compositions of the invention as relatively pure reagent chemicals. We have found that milk solids containing a substantial proportion of lactose in combination with proteins such as casein, can augment sucrose stabilization or provide a stabilizing effect. We have also found that borate compounds are also useful in combination with the vicinal hydroxyl compounds of the invention in stabilizing organic and particularly enzyme materials. Using general methods for forming solid block materials, the materials set forth in Table 2 were prepared using various proportions of dry milk or sucrose or combinations thereof as a source of lactose or sucrose as the vicinal hydroxyl stabilizer compound. The use of sucrose and milk stabilize the alkaline protease in a solid block detergent to some degree. Sucrose plus borate or sucrose plus borate plus milk solids provided surprising levels of stability when compared to the solid enzyme containing material without sucrose borate or milk solids.

TESTING TABLE 2

| | STABILIZERS | | | | | | |
|---|---|---|---|---|---|---|---|
| | Sucrose + Milk Solids | | | Sucrose + Borate | | Sucrose + Borate + Milk Solids | |
| COMPOSITIONS | S | U | V | Y | Z | W | X |
| Purafect 4000L (Commercial Alkaline Protease) | 5 | 4.765 | 4.55 | 5 | 5 | 5 | 5 |
| Dry Milk Solids | 5 | 4.76 | 4.55 | | | 5 | 5 |
| Water (deionized) | 15 | 14.76 | 14.09 | 15 | 15 | 15 | 15 |
| Sodium bicarbonate | | | | | | | |
| Sodium tetraborate pentahydrate | | | | 5 | 5 | 5 | 5 |
| $Na_2CO_3$ | 74 | 70.95 | 67.73 | 70 | 65 | 65 | 60 |
| Sucrose | | 4.76 | 9.09 | 5 | 10 | 5 | 10 |
| Residual Enzyme Activity after: | | | | | | | |
| A. overnight, 120° F. | 0 | 14 | 56 | | | | |
| B. 18 hours at 122° F. | no data | 7 | 22 | 69 | 79 | 80 | 89 |

Milk solids typically comprise a mixture of lactose and casein protiens.

We have also found the compositions have improved soil removal properties. The formulae used and test conditions are below. The formula used for comparison is a conventional alkaline solid carbonate solid detergent vs the same formula with 6% sucrose. Test concentration is 800 ppm of total detergent in the wash. Lipstick is read on redeposition glasses only. Lipstick results are based on an average of 3 separate glass readings used in the test. The rating system used in this test is as follows:

| | |
|---|---|
| No Lipstick | 1 |
| 20% Remaining | 2 |
| 40% Remaining | 3 |
| 80% Remaining | 4 |
| 100% Remaining | 5 |

Lipstick removal is reported based on removal after 1 cycle and removal after 2–10 cycles. We ran at least 3 additional but separate tests after this discovery and were able to duplicate (within experimental error) the results.

| Test Conditions: | Ingredients | Control Solid | Test Solid with 6% Sucrose |
|---|---|---|---|
| City Water (~4–5 grams) | 1. Caustic (grams) | 8.4 | 8.4 |
| 2000 ppm 3 food soils | 2. Water | 5.6 | 5.6 |
| Hobart C-44; 10 cycles | 3. Surfactant premix | 0.9 | 0.9 |
| Redep. = 3 redepositoin glasses | 4. Nonionic surfactant | 3.7 | 3.7 |
| Coated = 5 glasses dipped in whole milk and dried 8 mins. in humidity chamber (100° F./65% RH) | 5. Polyacrylic acid (50% aqueous active) | 2.0 | 2.0 |
| | 6. Dye | trace | trace |
| | 7. Caustic bead | 33.1 | 31.1 |
| | 8. Sucrose | | 6.0 |
| | 9. Sodium carbonate anhydrous | 2.5 | |
| | 9. Precoated sodium tripolyphosphate | 35.0 | 35.0 |
| | 10. Encapsulated chlorine source | 8.8 | 7.4 |

TABLE 3

| | | Testing Results | | | | | | |
|---|---|---|---|---|---|---|---|---|
| Use Conc. | Glass | Spots* | Film* | Starch* | Lipstick Cycle 2–10 | Lipstick Cycle 1 | Protein | Comments |
| | | | | Solid With 6% Sucrose | | | | |
| | Coated | 2 | 1.25 | 2 | — | — | 1.25 | Contact Redep. - Streaks |
| @ 800 ppm | Redep. | 1.75 | 1 | 1.75 | 1 | 1 | — | No Traces of Lipstick 41% Humidity |
| | Coated | 3.5 | 2 | 2.5 | — | — | 2.75 | Contact/Redep. - Streaks |
| @ 800 ppm | Redep. | 2.75 | 1.5 | 2 | 1.75 | 1 | — | Traces of lipstick on 10th cycle Humidity |
| | Coated | 1.75 | 1 | 1.75 | — | — | 1 | Contact/Redep. - Streaks |

TABLE 3-continued

| Use Conc. | Glass | Spots* | Film* | Starch* | Lipstick Cycle 2–10 | Lipstick Cycle 1 | Protein | Comments |
|---|---|---|---|---|---|---|---|---|
| | | | | Testing Results | | | | |
| @ 1000 ppm | Redep. | 1.5 | 1 | 1.5 | 1 | 1 | — | No Traces of lipstick 41% Humidity |
| | | | | Control Solid | | | | |
| | Coated | 4.5 | 2.25 | 1.75 | — | — | 3.5 | Coated - Spots; Redep. - Streaks |
| @ 800 ppm | Redep. | 3 | 2 | 2 | 4 | 5 | — | Lipstick throughout the 10 cycles |

A comparison of these results show that the sucrose containing solid exhibited surprisingly improved soil removal. In particular the lipstick removal is substantially better than expected compared to caustic solid detergents made without a carbohydrate stabilizer.

Test glasses are washed in an institutitonal warewash machine with a predetermined concentration of test or control detergent and 2000 ppm of food soil. Some of the test glasses are completely dipped in whole milk and dried before each cycle. Other glasses are left untreated and examined for soil redeposition.

Apparatus and Materials

1. Warewashing machine hooked up to the appropriate water supply.
2. Raburn glass rack
3. Libbey heat resistant glass tumblers, 10 oz.
4. Beef stew soil
5. Hot point soil
6. Potato Buds
7. Whole milk
8. Balance
9. Sufficient detergent to complete the test
10. Titrator and reagents to titrate alkalinity
11. Water hardness test kit
12. Coomassie Blue Dye:

| | |
|---|---|
| 50% Methanol in deionized water | 454 ml |
| Glacial Acetic Acid | 46 ml |
| Comassie Brilliance Blue R (50%) | 2.50 g |

Preparation

1. Clean 8 glasses.
2. Prepare food soil mixture. Prepare beef stew soil and hot point soil and mix equal weight of each soil to make a 50/50 mixture. A concentration of 2000 ppm food soil is maintained in the wash tank throughout the test with either a 50/50 beef stew, hot point soil or a ⅔ of a 50/50 mixture of beef stew, hot point along with ⅓ Potato Buds.
3. Fill the dishmachine with the appropriate water. Test the water for hardness. Record the value. Turn on tank heaters.
4. Wash cycle temperatures and rinse cycle temperatures should match field conditions. For our purposes this is 160–170° F. for the wash tank and 175–190° F. for the rinse water.
5. Turn on the dishmachine and let the detergent dispense or weight out proper amount and add into the machine at the appropriate concentration. Most of our tests are run at 1000 ppm detergent. Use a titrator and 0.10 N HCI to titrate washwater samples to ensure that the proper level of detergent is maintained throughout the test. Make any adjustments as needed to the dishmachine and dispensers to maintain the proper level of detergent.
6. Add enough food soil to the machine to bring up the concentration of food soil to 2000 ppm. To calculate this multiply the capacity of the wash tank in liters by 2.
7. Dip 5 of the glasses completely into whole milk and let dry for 8 minutes in humidity chamber at 100° F./65% RH. (These glasses will be dipped in whole milk and dried before each cycle of the test.) Place the glasses in the Raburn glass rack after they have been dried.
8. Place the other 3 clean glasses in the Raburn rack. Keep them separated from the milk treated glasses. On one of these glasses make a streak of lipstick every cycle with Cover Girl Really Red lipstick.
9. Determine how much water is replaced after each wash cycle. This will effect how much food soil and detergent if adding by hand is added after each wash cycle to the machine to keep the level of food soil constant.
10. In the Hobart C-44, 7 liters of water are exchanged after each wash cycle. We add 14 of food soil to the dishmachine every cycle to maintain 2000 ppm.
11. We take 5 glasses on the balance and weigh out 14 grams of food soil and appropriate amount of detergent if adding by hand into each glass. Doing 5 glasses at a time helps keep better track of how many cycles have been run. Add one of the glasses upside down, to the rack during each cycle through the dishmachine.

Procedure

1. Start the test. Run the rack through the dishmachine for one wash cycle. Resoil and dry the milk treated glasses. Leave the redeposition glasses in the rack. Remember to add food soil and detergent each cycle.
2. Repeat step 1 until five cycles have been run. Retest the washwater for alkalinity to maintain the proper level of detergent. Adjust the detergent level if necessary.
3. Repeat step 1 and 2 until 10 cycles have been run.
4. Let the glasses dry overnight. Grade all glasses for spot and film accumulation using a strong light source.

| Spots | | File | |
|---|---|---|---|
| 1 | No spots | 1 | No film |
| 2 | Random spots | 2 | Trace film |
| 3 | 1/4 surface | 3 | Light film |
| 4 | 1/2 surface | 4 | Medium film |
| 5 | 100% surface | 5 | Heavy film |

5. Dip one or two of the milk treated glasses into Coomassie Blue Dye for 20 seconds and then rinse well with tap water. The amount of blue dye retained on the glass is proportional to the amount of protein on the glass.

| | | |
|---|---|---|
| 1 | No blue | No protein |
| 1.5 | Trace blue | Trace protein |
| 2 | Light blue | Light protein |
| 3 | Medium blue | Medium protein |
| 4 | Dark blue | Heavy protein |
| 5 | Very dark blue | Very heavy protein |

Interpretation of Results

Milk treated glasses have the best results when very little spots, film, or protein have accumulated on them. A standard detergent should be tested and the glasses kept so that test formulas can be compared to the standard.

Explanation of Spot, Film and Protein Grading System

| Grade | Spots | Film | Protein |
|---|---|---|---|
| 1 | No spots | No film | No protein |
| 2 | Random amount of spots. There are spots but they cover less than 1/4 of the glass surface | Trace amount of film. This is a barely perceptible amont of film that is barely visibe under intense spot light conditions, but is not noticeable if the glass is held up to a fluorescent light source. | Light amount of protein. After dyeing glass with Coomassie blue reagent, the glass is covered with a light amount of blue. A trace amount of blue is a grade of 1.5. Protein film is not readily visible to the eye unless dyed. |
| 3 | 1/4 of the glass surface is covered with spots | A slight trace of film is present. The glass appears slightly filmed when held up to a fluroescent light source. | A medium amount of protein film is present |
| 4 | 1/2 of the glass surface is covered with spots | A moderate amount of film is present. The glass appears hazy when held up to a fluorescent light source | A heavy amount of protein is present. |
| 5 | The entire surface of the glass is coated with spots | A heavy amount of filming is present. The glass apppears cloudy when held up to a fluorescent light source | A very heavy amount of protein is present. A Coomassie dyed glass will appear as dark blue |

DETAILED DISCUSSION OF THE DRAWINGS

The data shown in FIGS. 1–8 correspond to a large body of experimental procedures conducted to demonstrate the value of the reversion inhibitor compounds of the invention. These experimental data were derived from preparations to that similar to that shown in Mixed Procedures 1–4 using the conditions shown in the figures. The percentages of reverted tripoly in the Figures refer to percent reversion based on total weight of solid detergent.

FIG. 1 shows the inhibition of reversion of sodium tripolyphosphate in a solid detergent using sucrose as a reversion inhibitor. In FIG. 1 the cast solid detergents are made with STPP having a 20–30 U.S. mesh, without barrier coating, at 125° F. in a castable material having 18.5 wt-% water. The figure shows four experiments with varying proportions of sucrose. As the sucrose concentration increases, the cast detergent obtains increased reversion protection.

FIG. 2 shows that surprisingly chlorine stability also increases with increasing amounts of sucrose in a solid block made similar to that shown in FIG. 1 except the solid block is made at 150° F. with 11 wt-% water. As the sucrose concentration increases, chlorine stability substantially increases. FIG. 2 shows percentages based on the detergent block originally containing 3.8 wt-% available chlorine.

FIG. 3 shows the results of a series of experiments similar to that shown in FIG. 1 except the solid blocks were made at 150° F. with 12.6 wt-% water. The sodium tripolyphosphate used was made with and without a barrier coating at either 0% sucrose or 6% sucrose. The best cast block is made with 6% sucrose and an EOPO block copolymer precoat on the tripolyphosphate.

FIG. 4 shows the results of a series of experiments similar to that shown in FIG. 3 except that the particle size of the STPP is about 60–80 U.S. mesh. While the smaller particle size resulted in increased reversion, the coated tripolyphosphate in the cast solid using 6% sucrose showed less than 2 wt-% reversion.

Figure 1:
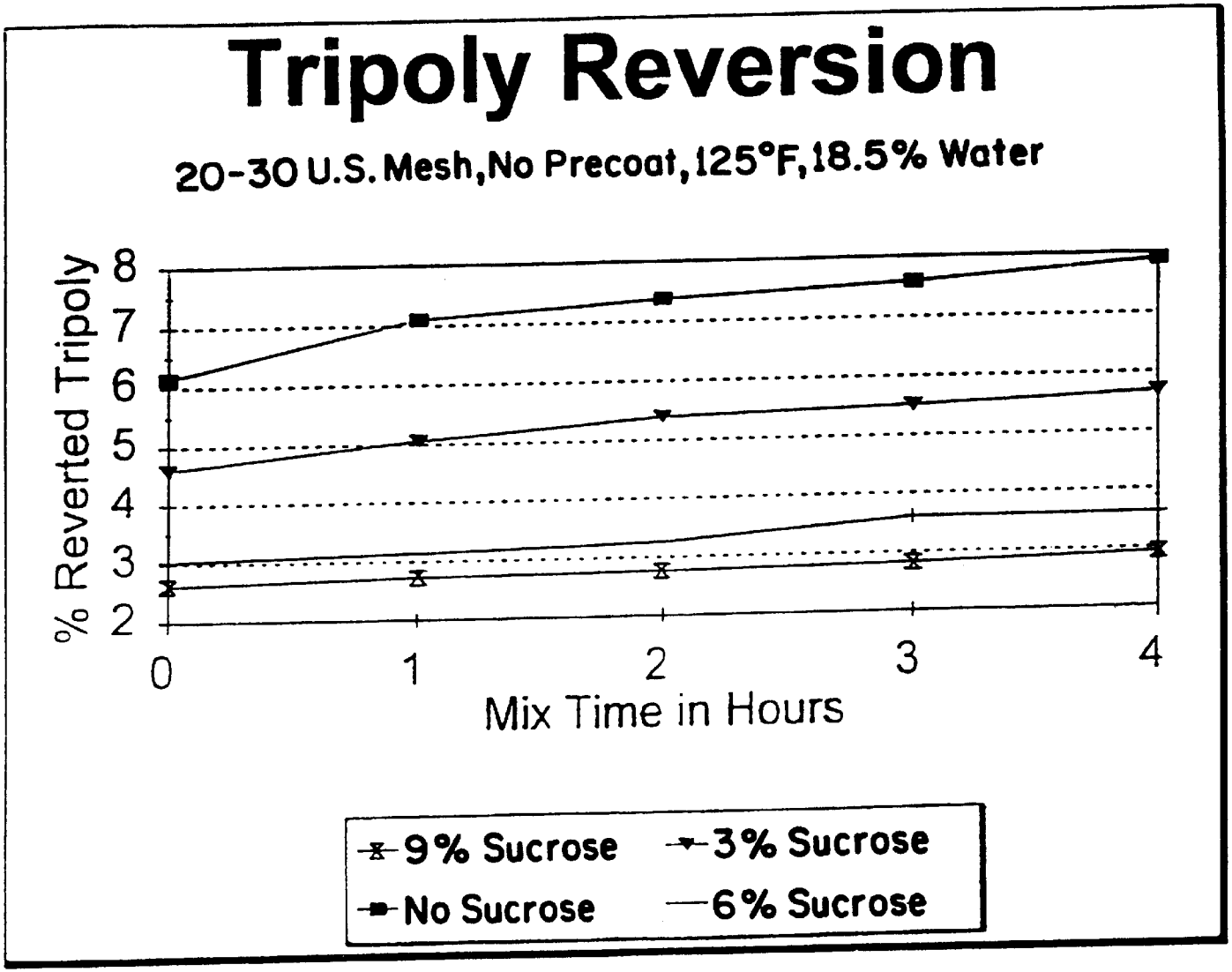
Figure 2:
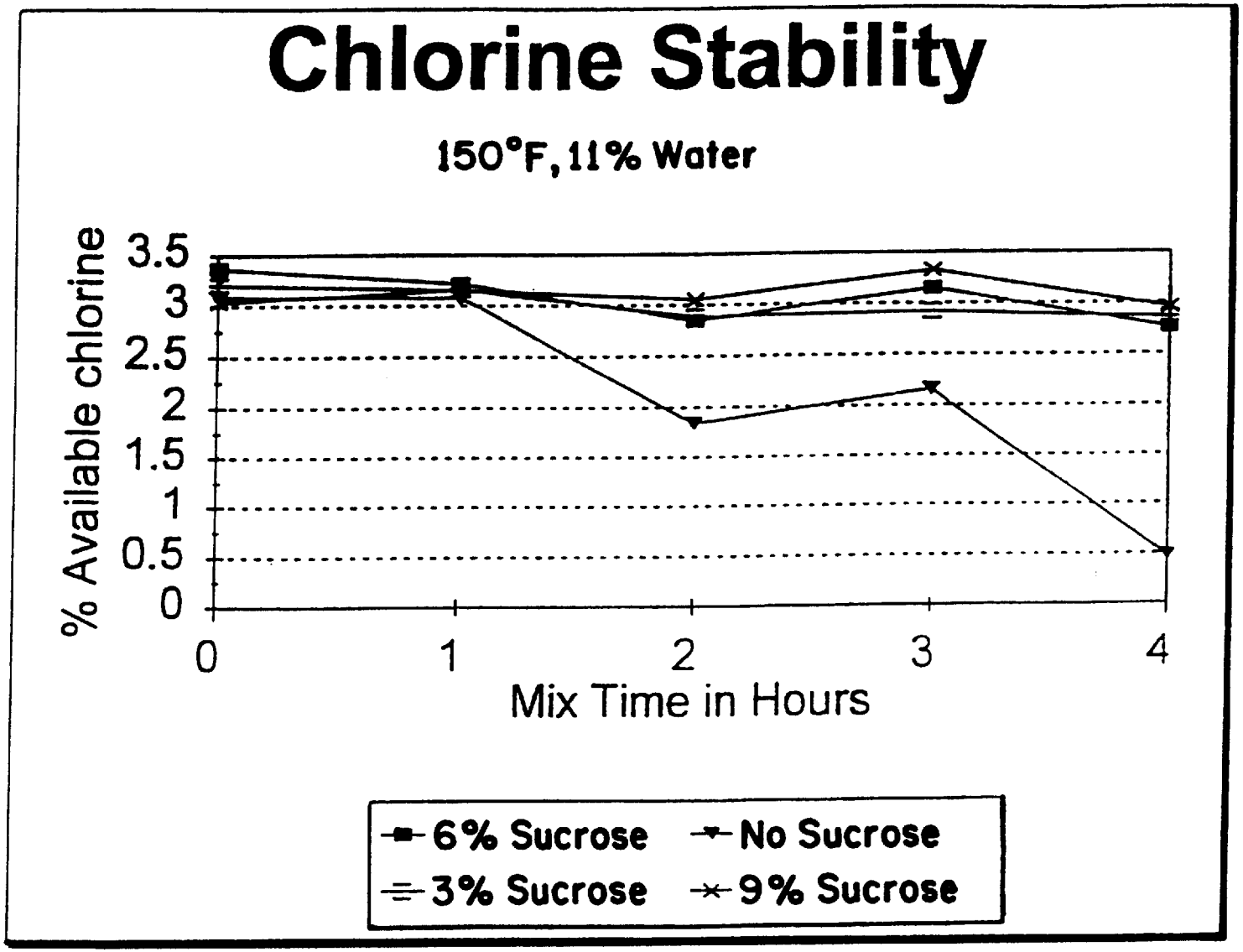
Figure 3:
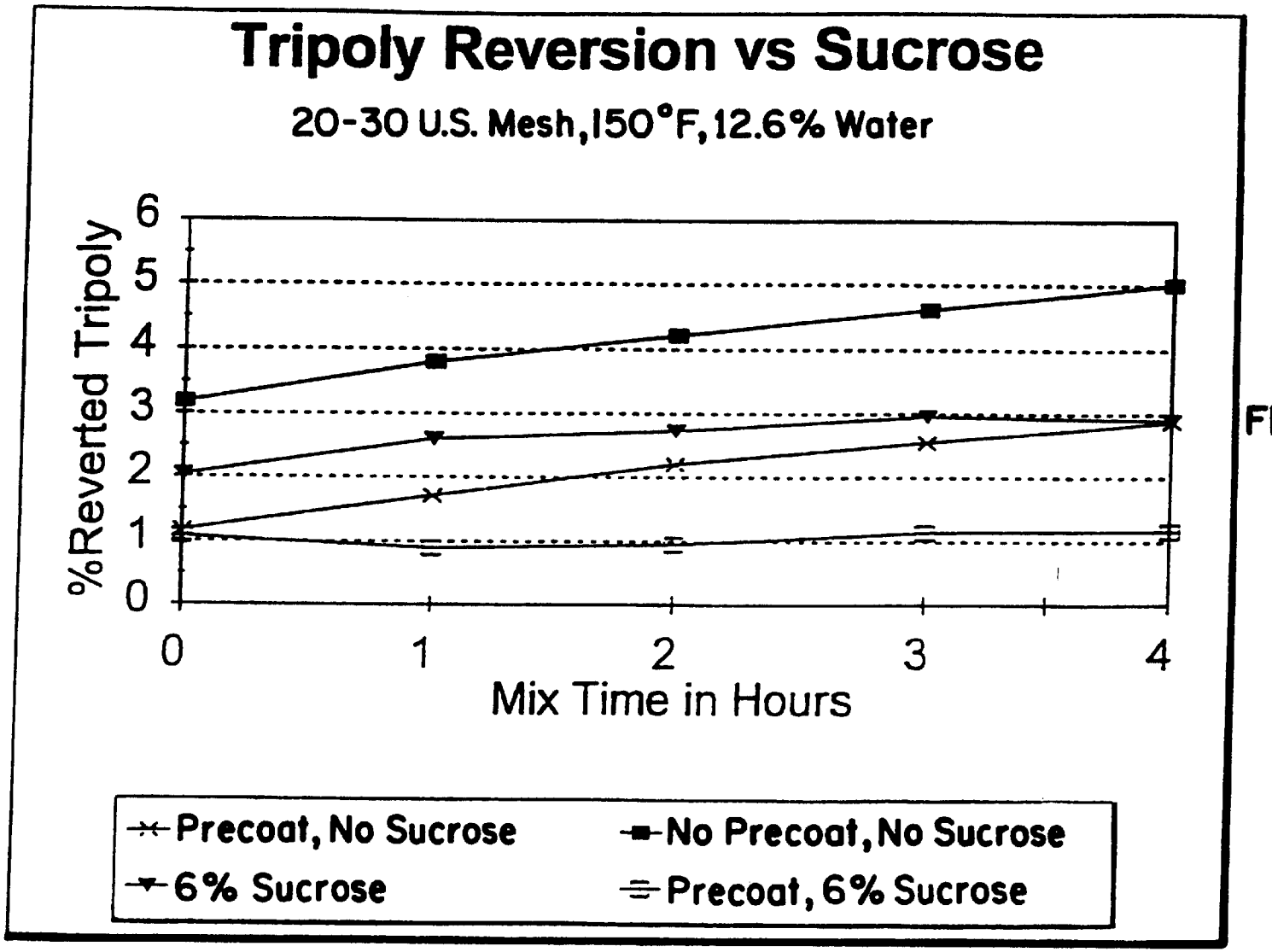
Figure 4:
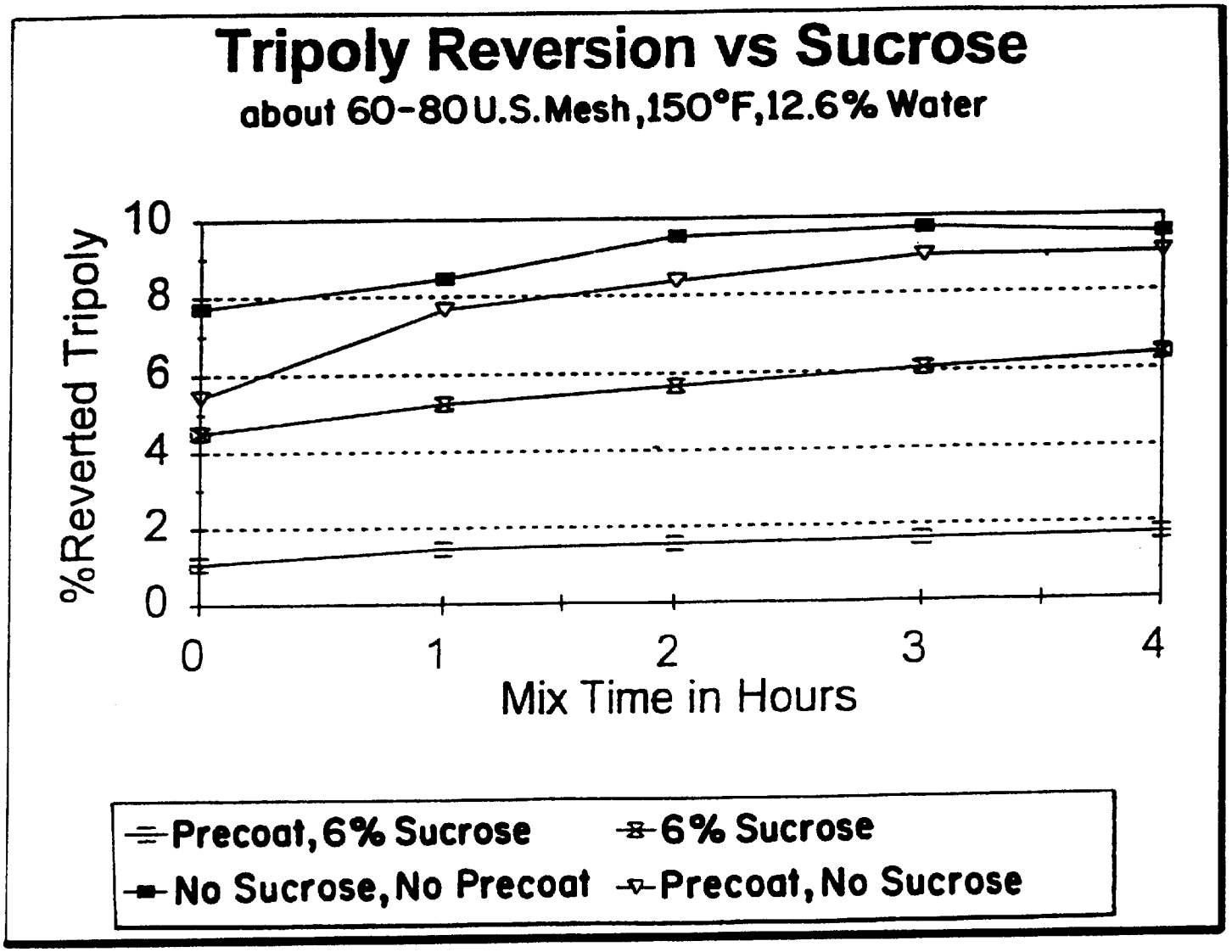
Figure 5:
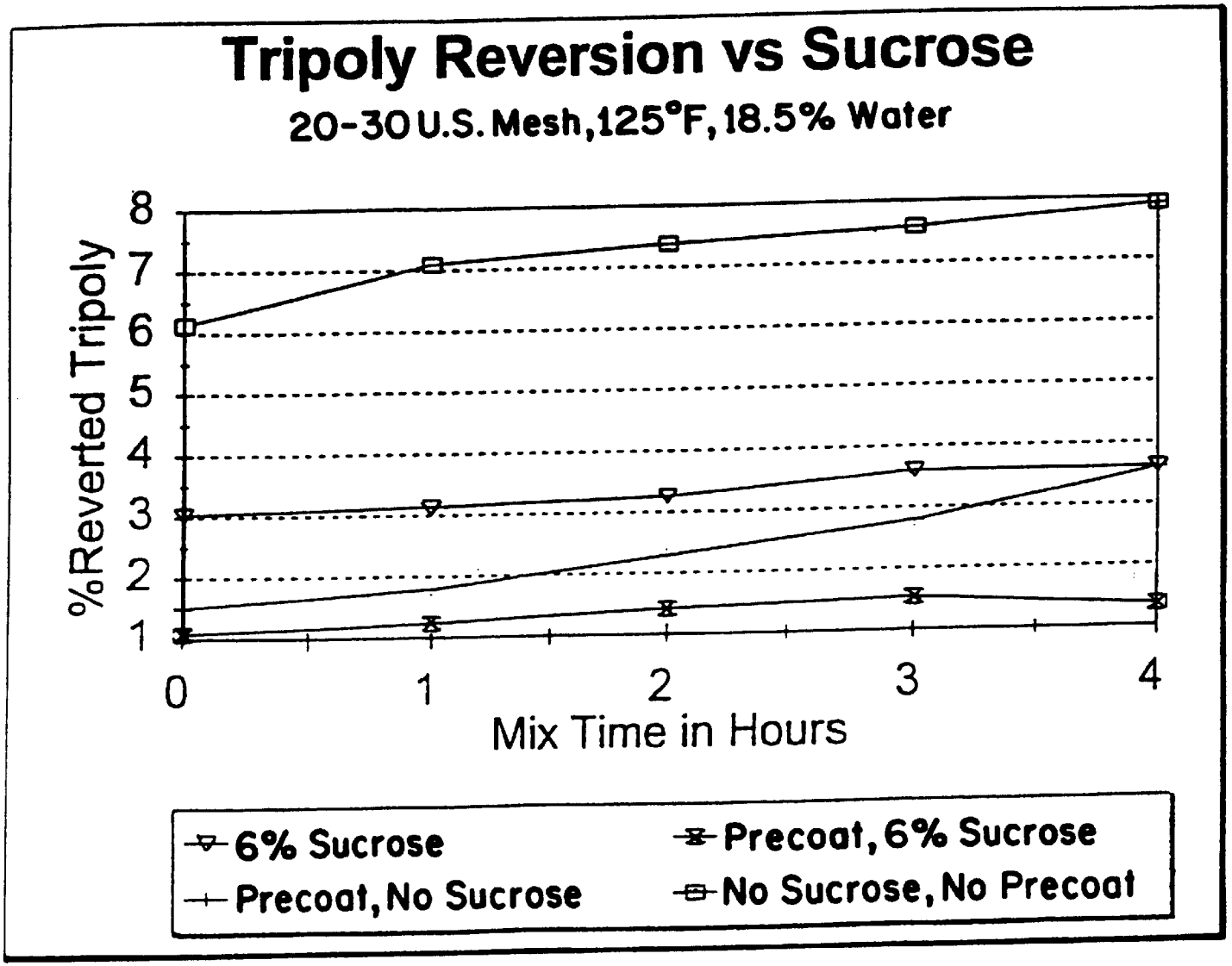
FIG. 5 shows the results of a series of experiments made under the same conditions in FIG. 1 with coated and uncoated STPP at 6% sucrose. The larger particle size at lower temperatures with a precoat and 6% sucrose showed substantial reversion inhibition.
Figure 6:
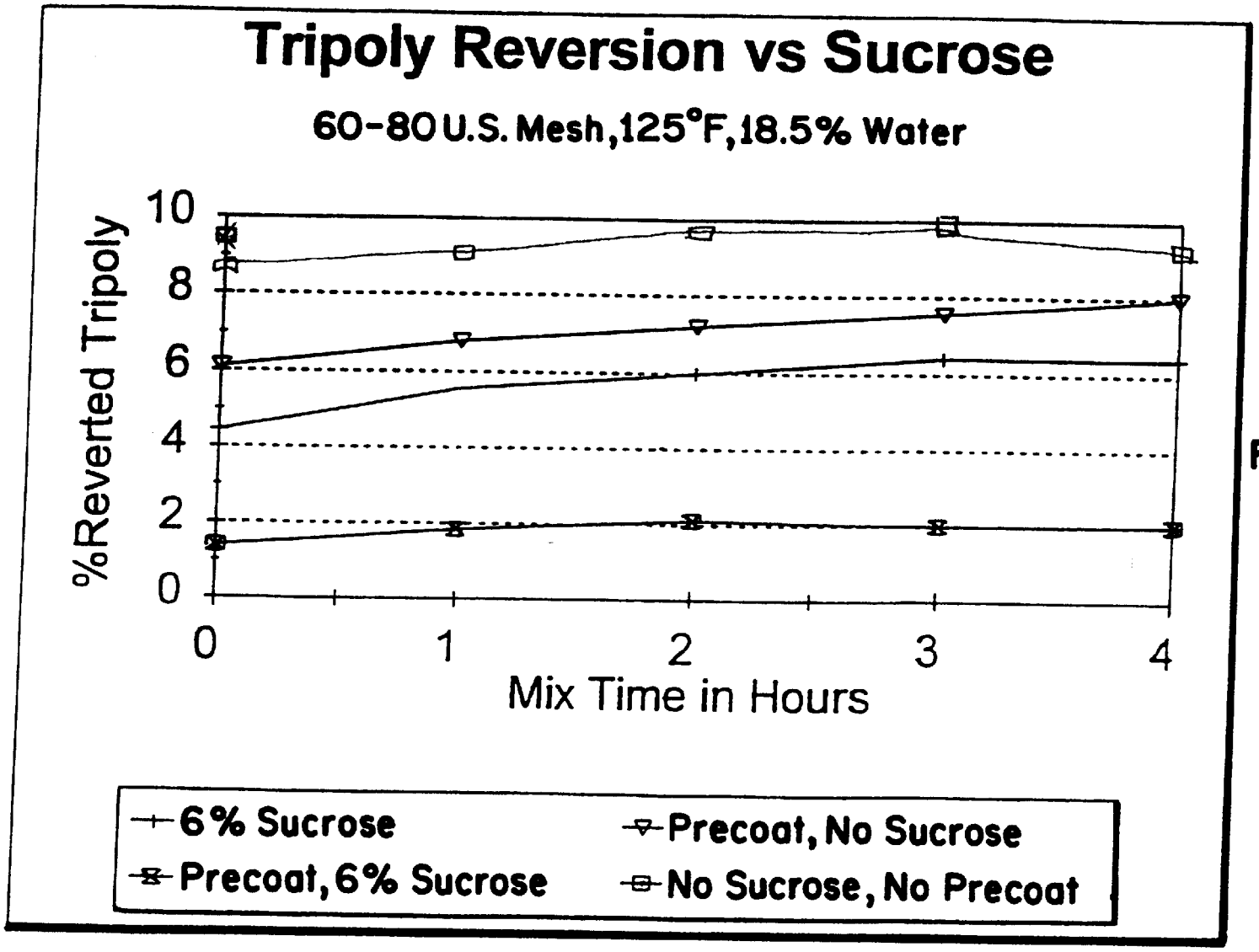
FIG. 6 shows the results of a series of experiments similar to that shown in FIG. 4 except the solid blocks were made at 125° F. and 18.5 wt-% water. Similar reversion inhibition is shown.
Figure 7:
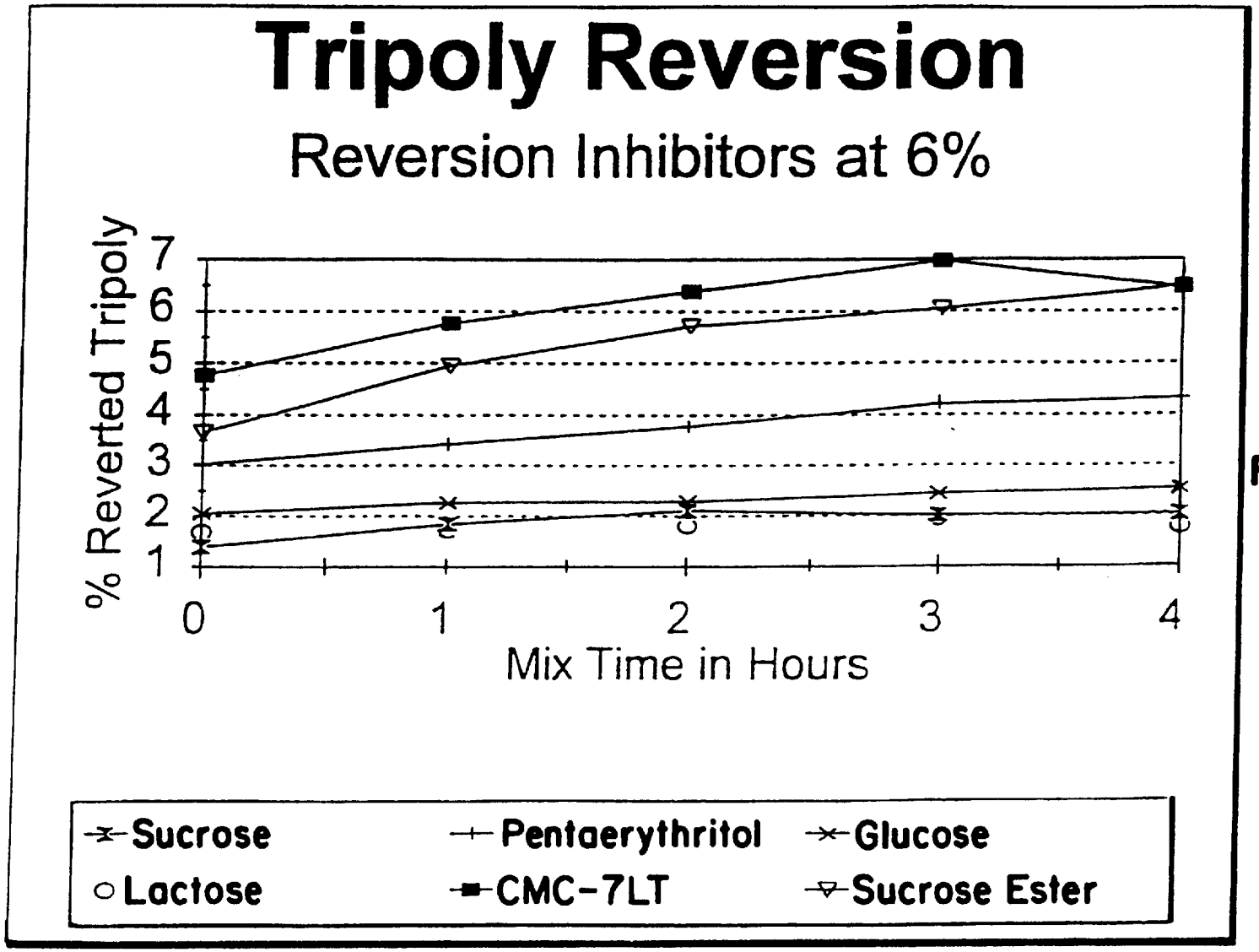
Figure 8:
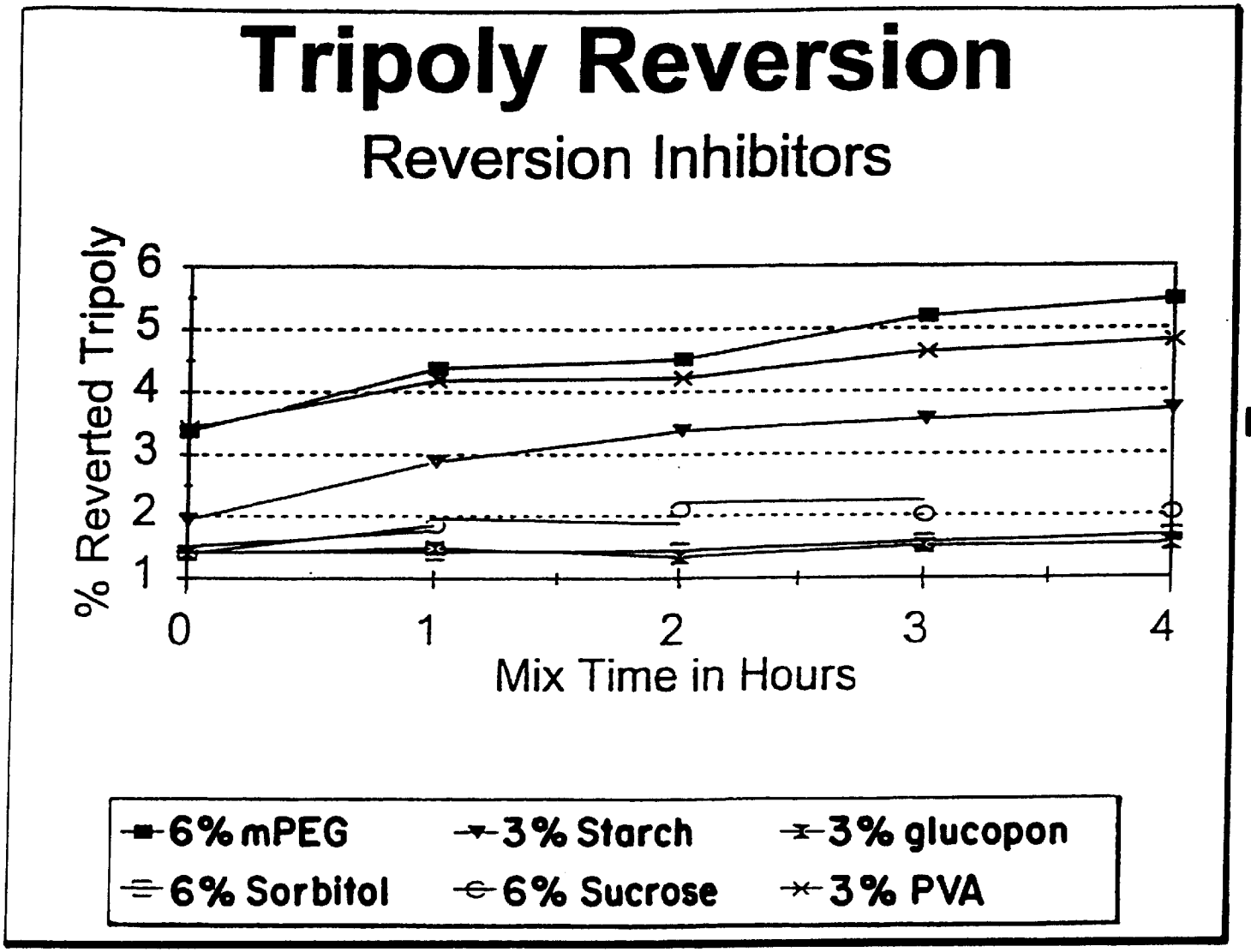

FIGS. 7 and 8 show the reversion inhibition capacity of a variety of proposed reversion inhibitor compounds at varying concentrations. These solid block detergents were made using conditions similar to that shown in the Mix Procedures 1–4. These experiments show that the preferred inhibitors are mono- and disaccharides.

Figure 9:
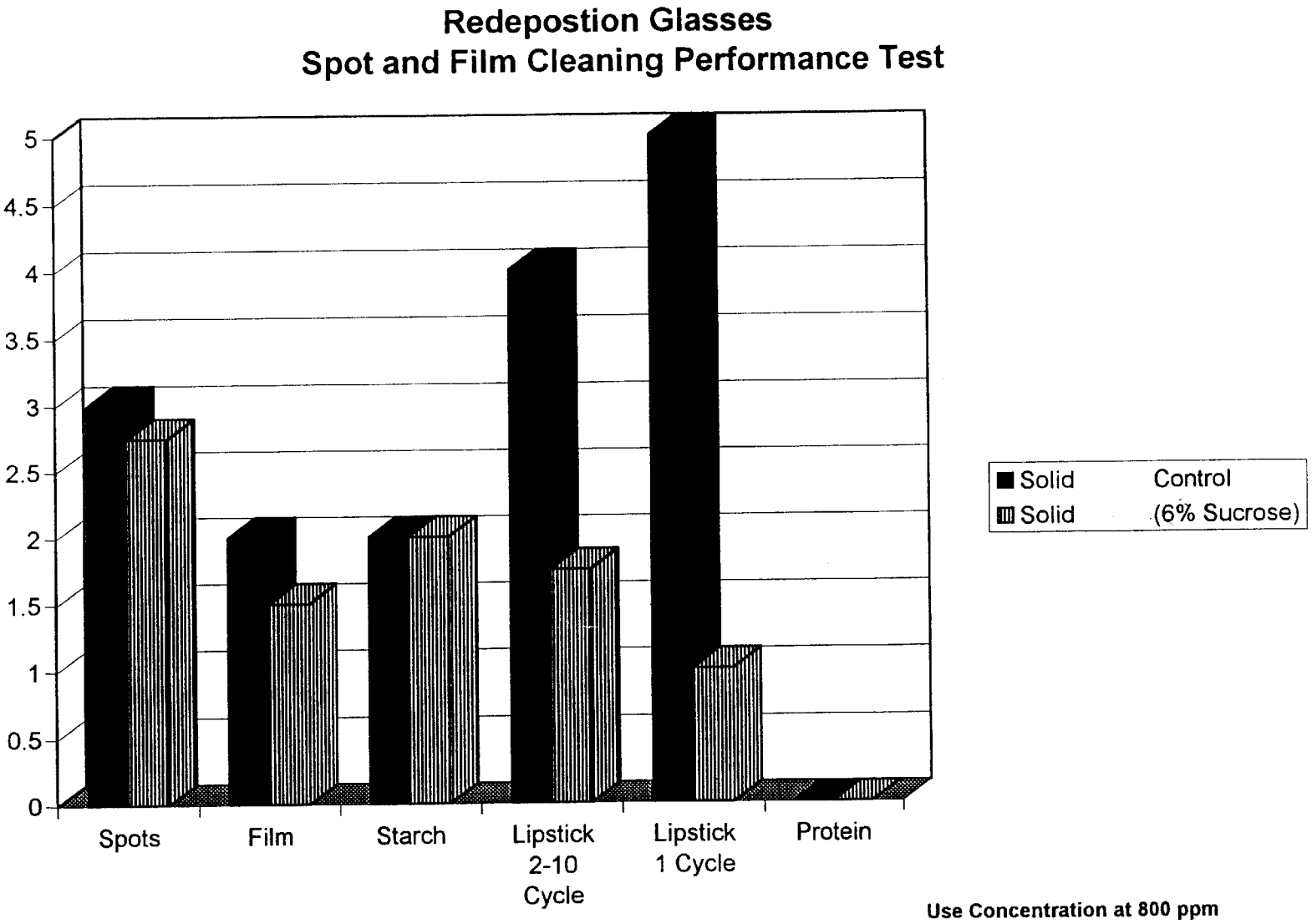

FIG. 9 shows that the stabilized solid detergent of the invention manufactured using 6 wt % sucrose has surprisingly improved cleaning performance. In control tests run using a solid alkaline detergent and an identical solid alkaline detergent made using sucrose, spot and film cleaning performances were markedly improved. In particular, the single cycle and multiple cycle lipstick removal properties of the detergent were markedly superior to a solid detergent made without sucrose.

The above specification, examples and data provide a complete description of the manufacture and use of the composition of the invention. Since many embodiments of the invention can be made without departing from the spirit and scope of the invention, the invention resides in the claims hereinafter appended. Percentages in the claims are based on the detergent composition as a whole.

We claim:

1. A method of manufacturing a solid block functional composition, said method stabilizing the components of the composition and inhibiting or reducing the hydrolytic instability of condensed phosphate sequestering agents, which method comprises (i) combining:

(a) an effective amount of an inorganic source of alkalinity;

(b) at least about 10 wt-% of a condensed phosphate sequestering agent;

(c) an effective stabilizing and reversion inhibiting amount of a reversion inhibitor, the inhibitor comprising a $C_4$ to $C_6$ monosaccharide or a disaccharide comprising sucrose, maltose, lactose or mixtures thereof, to form a blended mass; and (ii) forming the blended mass into a solid;

wherein less than about 15 wt-% of the condensed phosphate sequestering agent is reverted.

2. The method of claim 1 wherein the source of alkalinity comprises 20 to 60 wt-% of an alkali metal hydroxide.

3. The method of claim 1 wherein the source of alkalinity comprises 20 to 60 wt-% of a sodium silicate having a ratio of $Na_2O:SiO_2$ of equal to or greater than 1:1.

4. The method of claim 1 wherein the condensed phosphate sequestering agent comprises 15 to 50 wt-% of an alkali metal tripolyphosphate.

5. The method of claim 4 wherein the alkali metal tripolyphosphate comprises a particulate having a particle size of about 200 to 900 microns.

6. The method of claim 5 wherein the alkali metal tripolyphosphate comprises a barrier coating.

7. The method of claim 1 wherein the reversion inhibitor comprises a compound with three or more adjacent vicinal hydroxyl groups.

8. The method of claim 1 wherein the reversion inhibitor comprises about 1 to 15 wt-% of a carbohydrate.

9. The method of claim 1 wherein the reversion inhibitor comprises glucose, galactose, fructose, or mixtures thereof.

10. The method of claim 1 wherein the solid block functional composition additionally comprises a source of encapsulated chlorine and less than 30 wt-% of the encapsulated chlorine activity is lost during manufacture and packaging.

11. The method of claim 1 wherein the solid block functional composition additionally comprises an organic material.

12. The method of claim 11 wherein the organic material comprises a defoamer or surfactant.

13. The method of claim 12 wherein the defoamer comprises a phosphate ester defoamer.

14. The method of claim 1 wherein less than about 10 wt-% of the condensed phosphate sequestering agent is reverted.

15. The method of claim 1 wherein less than about 7 wt-% of the condensed phosphate sequestering agent is reverted.

16. The method of claim 2 wherein the source of alkalinity comprises sodium hydroxide.

17. The method of claim 1 wherein less than about 15 wt-% of the condensed phosphate sequestering agent is reverted during processing and packaging.

18. The method of claim 11 wherein the solid block functional composition does not substantially discolor after forming the blended mass into a solid.

19. The method of claim 1 wherein the blended mass is formed into a solid in a plastic container.

20. A solid block alkaline detergent composition containing an effective amount of a condensed phosphate sequestering agent, the stabilized composition comprising:

(a) about 10 to 60 wt-% of an inorganic source of alkalinity;

(b) about 10 to 45 wt-% of a condensed phosphate sequestering agent; and (c) about 1 to 15 wt-% of an effective stabilizing and reversion inhibiting amount of a reversion inhibitor, the inhibitor comprising a $C_4$ to $C_6$ monosaccharide, or a disaccharide comprising sucrose, maltose, lactose or mixtures thereof;

wherein the solid block is packaged within a container and wherein less than about 15 wt-% of the condensed phosphate sequestering agent is reverted.

21. The composition of claim 20 wherein the source of alkalinity comprises an alkali metal hydroxide.

22. The composition of claim 20 wherein the source of alkalinity comprises a sodium silicate having a molar ratio of $Na_2O:SiO_2$ of equal to or greater than 1:1.

23. The composition of claim 20 wherein the condensed phosphate sequestering agent comprises an alkali metal tripolyphosphate.

24. The composition of claim 23 wherein the alkali metal tripolyphosphate comprises a particulate having a particle size of about 200 to 900 microns.

25. The composition of claim 24 wherein the alkali metal tripolyphosphate comprises an exterior organic coating.

26. The composition of claim 20 wherein the reversion inhibitor comprises a compound with three or more adjacent vicinal hydroxyl groups.

27. The composition of claim 20 wherein the reversion inhibitor comprises a carbohydrate.

28. The composition of claim 20 wherein the reversion inhibitor comprises glucose, galactose, fructose, or mixtures thereof.

29. The composition of claim 20 wherein the solid block alkaline detergent composition additionally comprises a source of encapsulated chlorine and less than 30 wt-% of the encapsulated chlorine activity is lost during manufacturing and packaging.

30. The composition of claim 20 wherein the detergent composition additionally comprises an organic functional material.

31. The composition of claim 20 wherein the detergent composition additionally comprises a defoamer or surfactant.

32. The composition of claim 31 wherein the defoamer comprises a phosphate ester defoamer.

33. The composition of claim 20 wherein less than about 10% of the condensed phosphate sequestering agent is reverted.

34. The composition of claim 20 wherein less than about 7 wt-% of the condensed phosphate sequestering agent is reverted.

35. The composition of claim 20 wherein the source of alkalinity comprises sodium hydroxide.

36. The composition of claim 20 wherein less than about 15 wt-% of the condensed phosphate sequestering agent is reverted during processing and packaging.

37. The composition of claim 20 wherein the solid detergent does not substantially discolor after forming the blended mass into a solid.

38. The composition of claim 20 wherein the blended mass is formed into a solid in a plastic container.

39. A solid stabilized block alkaline functional material composition containing an effective amount of a functional agent selected from the group consisting of an enzyme, a nonionic surfactant, a chlorine source, the stabilized composition comprising:

(a) about 10 to 60 wt-% of an inorganic source of alkalinity;

(b) about 0.1 to 60 wt-% of a functional agent; and (c) about 1 to 15 wt-% of an effective functional stabilizing and reversion inhibiting amount of a reversion inhibitor, the inhibitor comprising a $C_4$ to $C_6$ monosaccharide, or a disaccharide comprising sucrose, maltose, lactose or mixtures thereof;

wherein the solid block functional material composition is packaged within a container.

40. The composition of claim 39 wherein the source of alkalinity comprises an alkali metal carbonate.

41. The composition of claim 39 wherein the source of alkalinity comprises a sodium silicate having a molar ratio of $Na_2O:SiO_2$ of equal to or greater than 1:1.

42. The composition of claim 39 wherein the solid block additionally comprises a condensed phosphate sequestering agent comprises an alkali metal tripolyphosphate.

43. The composition of claim 42 wherein the alkali metal tripolyphosphate comprises a particulate having a particle size of about 200 to 900 microns.

44. The composition of claim 43 wherein the alkali metal tripholyphosphate particulate comprises an exterior organic coating.

45. The composition of claim 39 wherein the organic stabilizer compound comprises a compound with three or more adjacent vicinal hydroxyl groups.

46. The composition of claim 39 wherein the organic stabilizer compound comprises a carbohydrate.

47. The composition of claim 39 wherein the organic stabilizer compound comprises glucose, galactose, fructose, or mixtures thereof.

48. The composition of claim 39 wherein in the solid block less than 30 wt-% of the encapsulated chlorine activity is lost during manufacturing and packaging.

49. The composition of claim 39 wherein in the solid block less than 30 wt-% of the enzyme activity is lost during manufacturing and packaging.

50. The composition of claim 39 wherein the nonionic functional material comprises a defoamer or surfactant and less than 30 wt-% of the nonionic is lost during manufacturing and packaging.

51. The composition of claim 50 wherein the defoamer comprises a phosphate ester defoamer.

52. The composition of claim 42 wherein less than about 10% of the condensed phosphate sequestering agent is reverted.

53. The composition of claim 42 wherein less than about 7 wt-% of the condensed phosphate sequestering agent is reverted.

54. The composition of claim 39 wherein the source of alkalinity comprises sodium hydroxide.

55. The composition of claim 42 wherein less than about 15 wt-% of the condensed phosphate sequestering agent is reverted during processing and packaging.

56. The composition of claim 39 wherein the solid detergent does not substantially discolor after forming the blended mass into a solid.

57. The composition of claim 39 wherein the blended mass is formed into a solid in a plastic container.

* * * * *